US005706670A

United States Patent [19]

Voorhis

[11] Patent Number: 5,706,670

[45] Date of Patent: Jan. 13, 1998

[54] BIDIRECTIONAL METERD FLOW CONTROL DEVICE

[75] Inventor: Roger J. Voorhis, Pennellville, N.Y.

[73] Assignee: Carrier Corporation, Syracuse, N.Y.

[21] Appl. No.: 758,130

[22] Filed: Nov. 25, 1996

[51] Int. Cl.[6] ..... F25B 13/00

[52] U.S. Cl. ..... 62/324.6; 137/493.8

[58] Field of Search ..... 62/324.1, 324.6; 137/493, 493.8, 493.9, 513.5

[56] References Cited

U.S. PATENT DOCUMENTS 5,052,192 10/1991 Drucker ..... 62/324.6

5,341,656 8/1994 Rust, Jr. et al. ..... 62/324.6

*Primary Examiner*—John M. Sollecito

[57] ABSTRACT

A device for controlling or metering fluid flow in either direction through a conduit. The device comprises an elongated body having two end walls forming an internal chamber therebetween. Disposed within the chamber is a free piston having an axial passageway extending therethrough. One end wall of the device has a metering orifice and one or more bypass openings. The other end wall also has a metering orifice and one or more bypass openings. Fluid flow through the device urges piston against the end wall in the direction of fluid flow. In this position, the piston blocks the bypass opening(s) in the end wall in the direction of fluid flow. Fluid flowing into the device can pass through the bypassing the opening(s) of the opposite end wall. Fluid flowing out of the device must pass through the metering orifice in the end wall in the direction of the fluid flow. Upon a flow reversal, the piston is urged against the opposite end wall. In this position, fluid will flow through the metering orifice in the end wall of the fluid direction and through the bypass opening(s) in the opposite end wall. The device is adapted for use in a reversible vapor compression air conditioning system. In this application, the sizes of the two orifices are different so that one can provide proper metering for cooling mode operation and the other can provide proper metering for heating mode operation.

5 Claims, 1 Drawing Sheet

BIDIRECTIONAL METERD FLOW CONTROL DEVICE

BACKGROUND OF THE INVENTION

This invention relates generally to devices for controlling the flow of a fluid within a conduit. More particularly, the invention relates to a device that is capable of controlling the expansion of a fluid, such as a refrigerant for example, in either flow direction through the device. An application for such a device is in a reversible vapor compression air conditioning system, commonly known as a heat pump.

Reversible vapor compression air conditioning systems are well known in the art. A conventional heat pump system has a compressor, a flow reversing valve, an outside heat exchanger, an inside heat exchanger and one or more expansion means for metering flow, all connected in fluid communication in a closed refrigerant flow loop. The inside heat exchanger is located in the space to be conditioned by the system and the outside heat exchanger is located outside the space to be conditioned and usually out of doors. The flow reversing valve allows the discharge from the compressor to flow first to either the outside heat exchanger or the inside heat exchanger depending on the system operating mode. When the heat pump system is operating in the cooling mode, refrigerant flows first through the inside heat exchanger, which functions as a condenser and then through the outside heat exchanger, which functions as an evaporator. When the heat pump system is operating in the heating mode, the reversing valve is repositioned so that refrigerant flows first through the outside heat exchanger and the functions of the two heat exchangers are reversed as compared to cooling mode operation.

All vapor compression refrigeration or air conditioning systems require an expansion or metering device in which the pressure of the refrigerant is reduced. In nonreversing systems, the expansion device need only be capable of metering the flow in one direction. In heat pumps and other reversible systems, the refrigerant must be metered in both refrigerant flow directions. It is not satisfactory to use a single capillary tube or orifice in a reversible system, as the metering requirement during cooling mode operation is not equal to the requirement during heating mode operation. A simple capillary or orifice optimized for operation in one mode would give poor performance in the other mode. One known method of achieving the requirement for proper flow metering in both directions is to provide dual metering devices in the refrigerant flow loop between the two heat exchangers. The first metering device, a flow control device such as a capillary or orifice, is installed so that it can meter refrigerant flowing from the inside heat exchanger to the outside heat exchanger (cooling mode). The second metering device, which is similar to the first metering device but optimized for operation in the heating mode, is installed so that it can meter refrigerant flowing from the outside heat exchanger to the inside heat exchanger (heating mode). Check valves are installed in bypass lines around the metering devices and in such an alignment so that refrigerant flow can bypass the first metering device during cooling mode operation and bypass the second metering device during heating mode operation. This arrangement is satisfactory from an operational perspective but is relatively costly as four components are required to achieve the desired system flow characteristics.

It is known in the art to combine in one device the functions of metering in one flow direction and offering little or no restriction to flow in the other. Such a device is disclosed in U.S. Pat. No. 3,992,898. In such a system, two such devices are installed in series in the refrigerant flow loop between the heat exchangers. The first metering device allows free refrigerant flow from the inside heat exchanger to the outside heat exchanger and meters refrigerant flow in the opposite direction to provide optimum metering capacity during cooling mode operation. The second metering device allows free refrigerant flow from the outside heat exchanger to the inside heat exchanger and meters refrigerant flow in the opposite direction to provide optimum metering capacity during heating mode operation. U.S. Pat. No. 4,926,658 discloses the use of a two way flow control device in a reversible vapor compression air conditioning system. As disclosed therein, this flow control device meters the flow of refrigerant in both directions, however it relies on a separate check valve in combination with a conventional expansion valve to properly condition the fluid for the appropriate cycle.

SUMMARY OF THE INVENTION

The present invention is a flow control device that will properly meter fluid, such as refrigerant in its gaseous state as utilized in a reversible vapor compression system, flowing in either direction through the device. In particular, the device allows different metering characteristics for each direction.

The flow control device includes a body having a first end wall, a second end wall, and a chamber formed therebetween. Each end wall further having a metering orifice passing therethrough and communicating with the chamber which is coaxially formed within the body between the spaced apart walls. A free floating piston is slidably mounted within the chamber and adapted to move in response to and in the direction of flow passing through the chamber between the first and second end walls. The piston includes a passageway extending therethrough in such a manner as to come into axial alignment and communicate with the metering orifice on each end wall. Each end wall farther has at least one bypass opening arranged such that the piston closes off the bypass opening in the end wall against which the piston is moved by the fluid flow. When the piston is moved by fluid flow in a first direction against the first end wall fluid flows unrestricted through the bypass opening in the second end wall moves the piston against the first end wall and closes off the bypass openings in the first end wall. The fluid flows through the passageway in the piston whereby a metered quantity of fluid is throttled through the metering orifice in the first end wall. When the flow of fluid through the device is reversed, the piston is moved in the opposite direction and comes into contact with the second end wall, closing off the bypass opening in the second wall and causing the fluid to flow through the metering orifice in the second wall. The size of the orifice in each of the end walls is sized to provide the proper metering of fluid flow in the respective direction of fluid flow.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
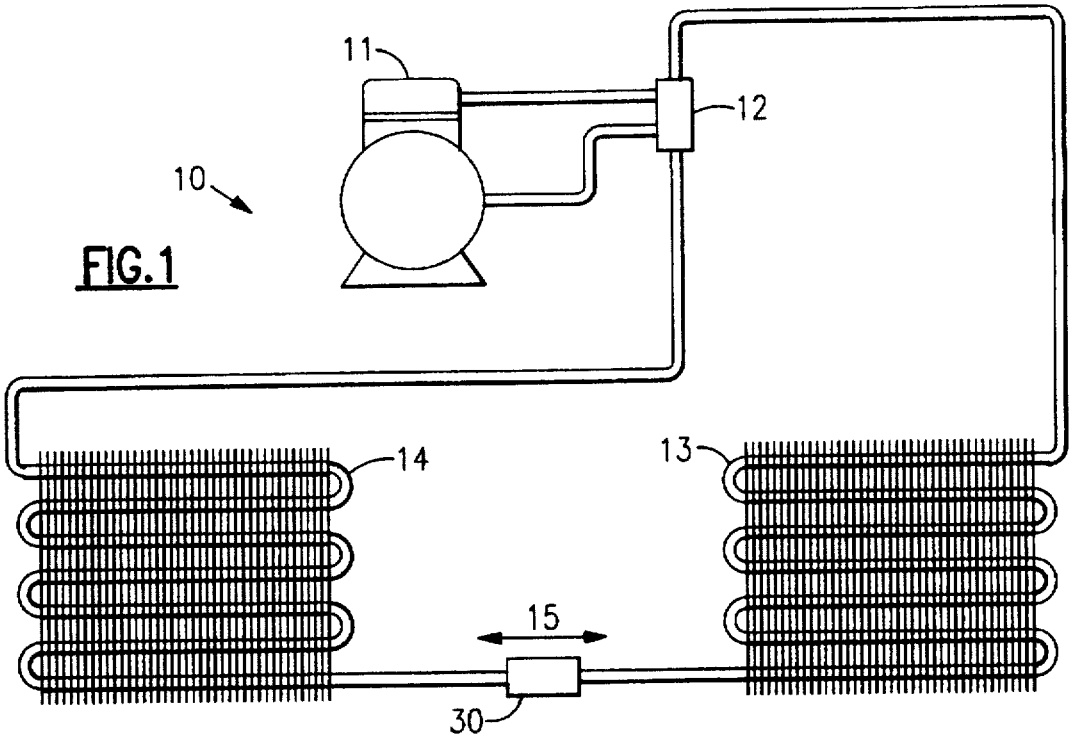
FIG. 1 is a schematic representation of a reversible vapor compression air conditioning system employing the flow control device of the present invention.

Referring to FIG. 1, there is illustrated a reversible vapor air conditioning system for providing either heating or cooling incorporating the bidirectional fluid control device 30 of the present invention. The system basically includes a first heat exchanger unit 13 and a second heat exchanger unit 14. In a cooling mode of operation the fluid flow 15 is from left to right. As a result heat exchanger 14 functions as a conventional condenser within the cycle while heat exchanger 13 performs the duty of an evaporator. In the cooling mode of operation the fluid, refrigerant, passing through the supply line is throttled from the high pressure condenser 14 into the low pressure evaporator 13 in order to complete the cycle. When the system is employed as a heat pump the direction of the refrigerant flow is reversed and the function of the heat exchangers reversed by throttling refrigerant in the opposite direction. The flow control device of the present invention is uniquely suited to automatically respond to the change in refrigerant flow direction to provide the proper throttling of refrigerant in the required direction.

Figure 2:
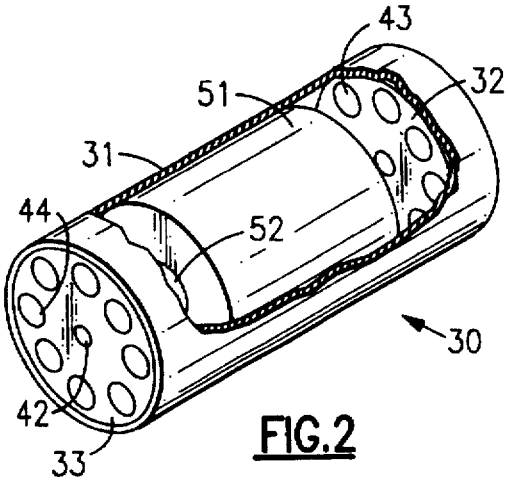
FIG. 2 is an isometric view in partial section of the flow control device of the present invention incorporated in the system illustrated in FIG. 1.

Referring to FIG. 2 the bidirectional flow control device of the present invention comprises a generally cylindrical body 31 with end walls 32 and 33 closing off the body to form internal chamber 34. The end walls 32 and 33 have a metering orifice 41, 42 centrally located and axially aligned with each other and the body. The end walls 32 and 33 each further have a plurality of axial bypass openings 43, 44 spaced radially outwardly from metering orifice. The bypass openings are preferably equally spaced from one another on each end wall.

Figure 3:
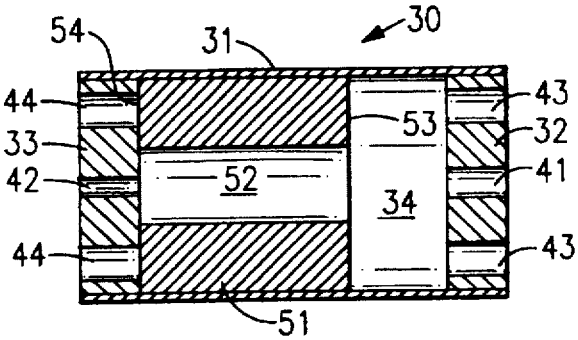
FIG. 3 is a plan view in section of the flow control device of the present invention incorporated in the system illustrated in FIG. 1.

A free floating piston 51 is coaxially disposed and slidably mounted within the internal chamber. The piston has a cylindrical body having a centrally located passageway extending therethrough axially aligned with the metering orifice in each of the end walls. The foreshortened piston is of a predetermined length, and is sized diametrically such that in assembly is permitted to slide freely in the axial direction within the internal chamber. The piston is provided with two flat and parallel end faces 53, 54. The left hand end face 54, as illustrated in FIG. 3, is adapted to arrest against end wall 33 of the internal chamber and the right hand end face 53 adapted to arrest against end wall 32. The bypass openings in each of the end walls are radially positioned such that they are closed off when the piston is arrested against the respective end wall. As shown in FIG. 3 the piston is arrested against end wall 33 and the bypass openings 44 are closed off from communicating with the chamber 34. The metering orifice 41 is sized properly to meter refrigerant fluid flow when the system 10 is operating in the cooling mode and the metering orifice 42 is properly sized for the heating mode.

In operation, the bidirectional flow control device 30, as shown in FIG. 1, controls the flow of refrigerant fluid flow between the heat exchangers 13, 14. When the system 10 is operating in the heating mode the fluid flow 15 moves as indicated from heat exchanger 13 to heat exchanger 14. Under the influence of the flowing refrigerant, the piston is moved to the left (when viewing FIG. 1) against end wall 33 and thereby closes off bypass openings 44. Refrigerant flows relatively unobstructed through bypass openings 43, as well as metered orifice 41, through passageway 52 and is forced to pass through the more restricted metered orifice 42 to throttle the refrigerant from the high pressure side of the system to the low pressure side. Similarly, when the system is operated in the cooling mode the cycle is reversed and the refrigerant is caused to flow in the opposite direction, the piston is automatically moved to the right (when viewing FIG. 1) against end wall 32 whereby the refrigerant is properly metered through orifice 41.

Device 30 may be configured in several variations. It may be sized so that its outer diameter is slightly smaller than the inner diameter of the tube that connects heat exchangers 13 and 14. During manufacture of the system, device 30 is inserted into the tube and the tube is crimped near both end walls 32 and 33 so that the device cannot move within the tube. Alternatively, the device can be manufactured with threaded or braze fittings, not shown, at both ends so that it may be assembled into the connecting tube using standard joining techniques.

Figure 4:
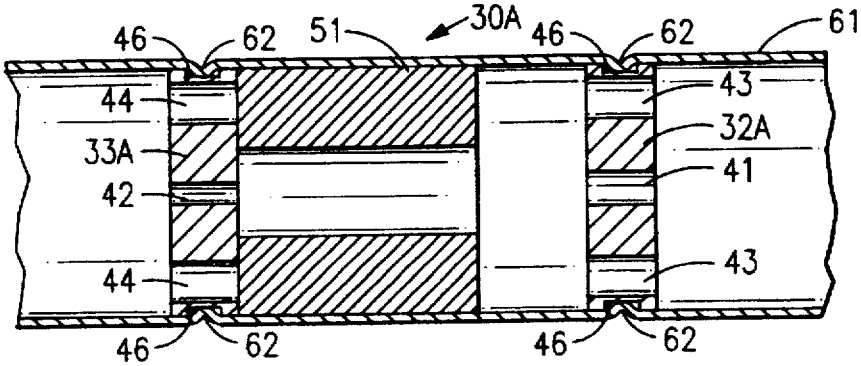
FIG. 4 is a plan view in section of another embodiment of the flow control device of the present invention.

Still another configuration is shown in FIG. 4. In that embodiment, tube 61 forms the cylindrical side wall of device 30A. End walls 32A and 33A, with free piston 51 between them, are inserted into tube 61. End walls 32A and 33A are similar in construction to end walls 32 and 33 shown in FIGS. 5 and 6, each respectively having an orifice 41 and 42 and one or more free flow passages 43 and 44. In addition, each of end walls 32A and 33A has a circumferential notch around its periphery. FIG. 8 shows circumferential notch 46 around end wall 33A. With end walls 32A and 33A and piston 51 properly positioned with respect to each other, tube 61 is crimped. The crimping creates depressions 62 into notches 46 that prevent the end walls from moving within the tube.

A bidirectional flow control device similar to that shown in FIG. 2 has been tested. The device was configured for a heat pump system having a 1.5 ton capacity and a nominal tube diameter of 0.25 to 0.38 inches, although the invention could conceivably be configured for any size system. The mass flow rates for the refrigerant, R22, in the cooling and heating modes were about 290 pounds per and about 130 pounds per hour respectively. In this configuration the width of each of the end walls and metering orifices was 0.378 inches. The diameter of the metering orifice for the cooling mode was 0.053 inches and the diameter of the metering orifice for the heating mode was 0.049 inches.

What is claimed is:

1. A device for controlling the flow of a fluid in a conduit in a first and second direction comprising:

an elongated body having a first end wall and a second end wall defining an internal chamber therebetween;

the first end wall having a metering orifice axially extending therein and in communication with the internal chamber and further having a bypass opening axially extending therein and in communication with the internal chamber;

the second end wall having a metering orifice axially extending therein, in communication with the internal chamber and in axial alignment with the metering orifice of the first end wall and further having a bypass opening axially extending radially outward from the metering orifice and in communication with the internal chamber;

a foreshortened piston disposed in the internal chamber and being slidably movable axially in response to fluid flow, the piston having a first end face parallel to the first end wall and a second end face parallel to the second end wall, and further having a passageway extending therethrough and in axial alignment with the metering orifice of each end wall;

whereby the piston closes off the bypass opening and establishes communication through the metering orifice in the direction of the fluid flow.

2. The device as set forth in claim 1 wherein the metering orifice disposed in the first end wall is of a different size than metering orifice disposed in the second end wall.

3. The device as set forth in claim 1 wherein the first and second end walls as disposed within the conduit.

4. A reversible vapor compression air conditioning system having a compressor, a first heat exchanger and a second heat exchanger being selectively connected to the compressor, switching means for selectively connecting the inlet and discharge side of the compressor between the exchanger and a refrigerant supply line for delivering refrigerant from one exchanger to the other, comprising:

a flow control device mounted in the supply line between each exchanger having an elongated body having a first end wall and a second end wall defining an internal chamber therebetween;

the first end wall having a metering orifice axially extending therein and in communication with the internal chamber and further having a bypass opening axially extending therein and in communication with the internal chamber;

the second end wall having a metering orifice axially extending therein, in communication with the internal chamber and in axial alignment with the metering orifice of the first end wall and further having a bypass opening axially extending radially outward from the metering orifice and in communication with the internal chamber;

a foreshortened piston disposed in the internal chamber and being slidably movable axially in response to fluid flow, the piston having a first end face parallel to the first end wall and a second end face parallel to the second end wall, and further having a passageway extending therethrough and in axial alignment with the metering orifice of each end wall;

whereby the piston closes off the bypass opening and establishes communication through the metering orifice in the direction of the fluid flow and permits the fluid to flow into the supply line.

5. A reversible vapor compression air conditioning system as set forth in claim 4 wherein the supply line comprises the elongated body.

* * * * *